United States Patent [19]

Reil

[11] Patent Number: 4,469,542

[45] Date of Patent: Sep. 4, 1984

[54] METHOD OF MAKING A PIECE OF TUBE FROM A FLAT WEB OF FLEXIBLE MATERIAL, AND APPARATUS FOR CARRYING OUT THE METHOD

[75] Inventor: Wilhelm Reil, Bensheim, Fed. Rep. of Germany

[73] Assignee: Tetra Pak Development S.A., Pully, Switzerland

[21] Appl. No.: 529,064

[22] Filed: Sep. 2, 1983

[30] Foreign Application Priority Data

Sep. 7, 1982 [DE] Fed. Rep. of Germany ..... 3233098
Feb. 22, 1983 [DE] Fed. Rep. of Germany ..... 3306053

[51] Int. Cl.[3] ..... B31B 5/26; B31B 1/42

[52] U.S. Cl. ..... 156/203; 156/466; 493/81; 493/179; 493/182; 493/295

[58] Field of Search ..... 156/461–466, 156/200–203; 493/69–72, 179–182, 199–202, 295

[56] References Cited

U.S. PATENT DOCUMENTS

| | | | |
|---|---|---|---|
| 3,838,632 | 10/1974 | Miyake | 493/295 X |
| 3,884,131 | 5/1975 | Palsson | 493/135 |
| 4,295,841 | 10/1981 | Waud | 493/295 |
| 4,331,499 | 5/1982 | Madsen | 156/203 X |

*Primary Examiner*—David A. Simmons
*Attorney, Agent, or Firm*—Biebel, French & Nauman

[57] ABSTRACT

Pieces of tube are produced from a flat flexible web by feeding the web intermittently into apparatus which first makes transverse incisions from each edge partly across the web at a spacing equal to the desired tube lengths. The side portions between the incisions are then folded along longitudinal fold lines so that their end edges overlap and are welded together. In a subsequent operation, the non-incised central flat portion of the web is severed in line with the incisions and the tube elements thus formed are then moved transversely to the direction of web movement by a reciprocating slide to stand upright on tube-shaping members.

13 Claims, 6 Drawing Figures

METHOD OF MAKING A PIECE OF TUBE FROM A FLAT WEB OF FLEXIBLE MATERIAL, AND APPARATUS FOR CARRYING OUT THE METHOD

BACKGROUND AND SUMMARY OF THE INVENTION

The invention relates to a method and apparatus for making a piece of tube from a flat web of flexible material, particularly paper coated with plastics, by grooving, stamping, cutting and folding, wherein the web is pulled off a storage roll and intermittently conveyed, and after folding over into tube form the longitudinal edges of the web are continuously interconnected by adhesion, welding or the like, and the web is severed.

Methods of the above type, for making packs, particularly for liquids, and apparatus for carrying out such a method, are known in the form of filling machines in the manufacture of liquid packs for milk or fruit juices. From a flat web of paper, coated with plastics on both sides and pulled intermittently off a storage roll, a tube is formed after grooving and stamping lines have been applied; the tube is filled with the liquid to be packed and is shaped into individual packs by welding means, after which individual pieces of tube, which are then divided from one another by transverse seams, are separated by cuts extending through these stamped lines.

It has been found that packs of this type can be made with large throughputs, with most packs of this known type being closed by folding and welding, both at the bottom and the top. The disadvantage here, however, is the space requirement with such manufacturing processes and machines, because great lengths are necessary for a flat web, drawn off a storage roll and driven continuously and possibly also intermittently, to be reshaped into a tube and for the tube to be formed by means of a longitudinal seam. In the known method extensive welding installations also have to be used, because once the tube has been made, i.e., when the longitudinal edges of the web have been joined together, it is filled with liquid at a subsequent stage. The liquid necessarily exerts a certain pressure on the pack surrounding it, and thus also on the new seam, so that without special welding equipment there would be a danger of the new seam bursting open.

In addition it has already been propposed to provide a pack with a lid or top made of plastics without supporting material, the pack thereafter being filled and only subsequently closed at the bottom by folding. To make such a pack, pieces of tube must be made in the shape of a cylindrical surface and put into an injection molding machine, in which the top component or lid with an opening is molded onto the cylindrical pieces of tube at one side. Molding onto cylindrical pieces of tube with large throughputs obviously creates insuperable difficulties for the expert; for one can hardly think of a machine with which pieces of tube can be shaped from a flat web with such precision that a desired matching internal dimension can be obtained, to which firstly a molding tool and secondly the molded piece of plastics can be fitted with its dimensions exactly matching.

The problem underlying the invention is to provide a method of making such a piece of tube from a flat web, and an apparatus for carrying out such a method as described more fully above, whereby the web of elastic, flexible material can be shaped into a tube and separated over a very short distance, while the piece of tube is very accurately dimensioned.

According to the invention the problem is solved in respect of the method, in that before the longitudinal edges of the web are joined, the web is partly incised at least from one longitudinal side, transversely to the conveying direction, that the tube is formed only by folding in these side sections divided by the incisions, that the non-incised part of the web is kept supported substantially flat, and that when the longitudinal edges of the web have been joined, their flat portion is severed in line with the incisions. The particularly novel idea of the invention is to leave the web of material at least partly in web form in one piece until the final severing, but to join together the longitudinal edges of the web, so that at least a partial tube is formed, before the final severing step, i.e., before the individual pieces of tube are separated. The tube is already divided, by the said incisions transversely to the longitudinal side of the web, into pieces which later form the length of the piece of tube produced. The shaping of a tube while the web of material partly remains in one piece is a process not hitherto known and allows for various treatments which were not previously possible in the formation of a tube.

For example, with the new method according to the invention, a piece of tube can be formed over a very short distance, if the web of material drawn off the reel is considered. Welding is also possible with very short welding times and the use of the simplest welding methods. This makes the desired pack considerably cheaper to produce.

In accordance with the invention it is further advantageous if incisions of approximately equal length are made in the flat web from both longitudinal sides, the inner end of the incisions extending as far as the grooved lines formed in the web, and if the sum of the areas of the side sections divided by the incisions is larger than the area of the central, flat portion of the web between successive pairs of incisions. The grooves can be made by the paper manufacturer. It is also possible, however, for the grooved lines to be made with the machine carrying out the method of the invention, at the beginning of the process described here. The grooved lines run in the direction in which the web is conveyed. They are used for folding in the side sections, formed by the incisions, onto the central, flat part of the web formed thereby. If one considers the piece of web which later becomes the piece of tube, between the successive pairs of incisions, then the area of the central flat part can be compared with that of the folded-over side sections. If the sum of the areas of the folded-over side sections is larger than that of the central part of the web, then the tubular cross-section formed will have one part slack and the other part curved. The curved part is that with the larger area, in the case of the present example with the side sections folded over. However, the longitudinal edges of the web, which have to be welded together, are on this part. Welding in this form is advantageously carried out without tension, and this is the reason why the simplest welding method can be used, with very short welding times and without any cooling time, preferably the use of constant contact heat. After the welding process there are in fact no forces in the web of paper or tensions therein which would put any appreciable strain on the new seam.

In a further advantageous embodiment of the invention, the side sections, which are folded in along the grooved lines and shaped as the piece of tube, are pressed together at one end adjacent the incisions to form a cone. It has been explained above that, when a lid is molded onto one end of a piece of tube, exact dimensions have to be observed if only for the sake of injection molding tools. It is also pointed out that it is extremely difficult to shape a tube or piece of tubing with exact internal dimensions, so that these could be drawn at all exactly onto a mandrel. But such a drawing action would be possible if, in accordance with the invention, the shape of the piece of tube were frustoconical. To obtain the conical shape one end of the piece of tube must have a smaller diameter than the opposite end. Since the grooved lines can most simply be formed in the web if they run parallel with the web conveying direction, the above-mentioned measure according to the invention has to be carried out, namely, compressing the side sections at the appropriate end of the piece of tube in the region of the grooved line. If this compression takes place immediately before or during the welding process, the seam takes up the reduction in diameter, achieved by pressing together beyond the grooved line, and immediately fixes the reduction in diameter. In this way a slightly conical piece of tube is obtained in a very simple manner and in addition is partly still unseparated, i.e., is part of a web.

It is therefore advantageous if, in a further embodiment of the invention, after the severing of the flat part of the web the separated piece of tube is pushed aside transversely to the conveying direction of the web and stood upright to form a circular cross-section. The central part of the web which was kept flat gave the piece of tube a cross-section which was not previously not circular, e.g., substantially the cross-section of a segment of a circle. It is therefore favorable for the cross-section of the piece of tube to be erected at least approximately into the shape of a cylindrical surface after separation, i.e., after severing in line with the previously made incisions; one end of the cylinder, as mentioned above, having a slightly larger diameter than the other end, so that in an exaggerated description one could speak of a truncated cone. If the molding tool then has the shape of a tapered mandrel as the opposing molding tool, even a very slightly frustoconical tubular member could clearly easily be slid over the mandrel by appropriate ejection means, so that towards the end of the sliding process the narrow side of the truncated cone comes to rest really tightly over the front of the mandrel, i.e., with the appropriate dimensions fitting. This last described side of the mandrel is then a part of the injection mold, so that the halves of the tool can be placed very accurately around the end of the piece of tube.

In accordance with the invention, the apparatus for carrying out the method has cutting, feeding and folding means and is characterized in that a flat supporting plate, extending from the folding-in station to the severing station, is held stationary in the conveying direction of the web, in such a way that the web engages at least partly around it, that feed drive rollers are arranged above and below the web in the conveying directon, between the welding station which has at least one constant contact heating jaw, and the severing station which has a movable cutter, and that a distributing station with a means for standing the tube upright is arranged downstream thereof. With these measures it is possible to bring the web of flexible, elastic material, such as the web of paper coated on both sides used here to explain the invention, into the above-mentioned tubular shape with the segment shaped cross-section, by cutting and folding in. Part of the web lies under the supporting plate, while the two side sections folded over are arranged above it. This arrangement can be obtained if in accordance with the invention, the folding-in station has levers, which are rotatable about a spindle lying in the web conveying direction, and transverse mandrels, which are fixed to the levers and parallel with the spindle. When the web has been incised transversely to the longitudinal direction to form the side sections, the rotatable levers turn and swivel the transverse mandrels inwardly around the said spindle over the supporting plate, so that the plate is now almost completely surrounded by the web of material. With the continuous web being moved forwards intermittently or by degrees from the folding-in station to the succeeding welding preheating station, it may be desirable for the backing welding jaw to be arranged over the supporting plate and for the longitudinal edges of the web which have to be joined together to be slid over that jaw, while the transverse mandrels are still held in the swivelled-in position or holding rails maintain this tubular position of the web of paper. When the web is conveyed further into the welding station, the longitudinal edges to be joined together lie directly between the welding jaws in the desired manner, so that the tube can be formed, although part of the tube, in the form of the central flat region of the web, still remains part of the continuous web.

It is further desirable, according to the invention, for an adjustably displaceable incising means with a photoelectric cell controlling the drive rollers to be arranged before the folding-in station in the web conveying direction. In this way the apparatus can be adjusted to pieces of tube of different lengths. The distance between the line joining the two incisions and the photoelectric cell will remain the same in all embodiments, but the distance between this cutter or the photoelectric cell and the cutters of the severing station may be varied according to the necessary division of space or the number of pieces of tube therebetween. The apparatus can thus be adapted to different products by simple means.

It is also advantageous, according to the invention, for the welding station to have pressure jaws, arranged laterally adjacent the edges of the supporting plate and movable at a small angle of inclination thereto. In this way an exact internal dimension for the piece of tube can be obtained without a calibrating mandrel. It has already been mentioned above in the same connection that it is desirable to be able to make conical lengths of tubing, because a truncated cone can be drawn over a mandrel more easily than an exact cylindrical tube particularly if one considers that one end of the tube has to be placed with an exact fit over the end of the mandrel forming the casting mold member. The conical length of tubing can be made successfully with the movable pressure jaws mentioned. They are at a small angle of inclination, as seen in the web conveying direction—to the longitudinal side edges of the supporting plate. The jaws move perpendicularly to the web conveying direction. With their help it is thus possible for one end of the piece of tube, the front end as seen in the conveying direction, to be impinged on with a pressure against the edge of the supporting plate, while there is no pressure on the other side. As a result of this pressure the particular side wall section, formed by the incisions, adjacent the grooved line formed is pressed against the supporting plate, so that the tensions in the paper are thereby virtually eliminated. With the pressure jaws the paper is pressed virtually beyond its tension around the edge of the supporting plate, i.e., against resistance from the flat paper, because folding over takes place in the vicinity of the grooving and not in the grooved line itself. Since these movable pressure jaws are provided in the region of the welding station, the reduction in the diameter of the piece of tube at this location is immediately fixed by the welding process. It has been found in practice that a conical length of tubing can be obtained and manufactured very easily with these means, with part of the tubing still belonging to continuous webs, and that when the finished piece of tube has been severed and separated, an exact internal dimension is obtained without a calibrating mandrel; for the compression around the edges of the supporting plate takes place in such a controlled manner that exactly the desired internal dimension for the finished piece of tube is finally achieved.

It is also desirable, according to the invention, for at least one feed drive roller to have a central recess at the periphery. As seen in the conveying direction of the web the feed drive rollers are arranged behind the welding station. This does not provide any disadvantages in conveying the web, for the web extends continuously as far as the storage reel. The advantage of having the rollers arranged behind the welding station is that the drive rollers hold down the piece of tube, so that there is virtually a flat tube in cross-section, with the feed drive roller advantageously running directly over the welded seam. The above-mentioned central recess is provided to prevent the seam from being undesirably strained. Thus any stress on the seam, e.g., the occurrence of undesirable dislocations, is advantageously avoided. The so-called edge protector, which is a thin film in the region of the longitudinal seam, is also protected by the central recess, since otherwise with the line contact excessively high pressures might possibly be transmitted to the edge protecting film.

In another advantageous embodiment of the invention, connecting rails extending transversely to the web conveying direction are mounted in the distributing station and span the width of the supporting plate. Tube shaping members are fixed to the ends of the these rails, and a slide is guided movably between the rails. The slide is moved in cadence transversely to the web conveying direction, to the left or right, depending on the direction in which the piece of tube separated by the severing station is pushed aside. The throughput or machine output of the apparatus according to the invention can be considerably increased if the pieces of tube made from the web are divided into two methods of treatment, since then each method of treatment has more time for further processing, particularly when a lid or base is molded onto a piece of tube. Towards the end of each particular stroke the slide is always located outside the web and thus outside the width of the supporting plate, which of course is not absolutely necessary downstream of the severing station. It is more desirable for the tube or piece of tubing to be empty inside downstream of the severing station, so that the slide can push the tube aside without a great outlay on apparatus. It desirably pushes it into a tube shaping member at the appropriate side, with a circular diameter in cross-section, in which the piece of tube is then set upright into the desired shape. The slide may preferably assist in the erecting process by pressing into the end position. The next piece of tube will then be ready behind the severing station, so that the slide can reverse its direction of movement transversely to the conveying direction and push the next length of tubing in the opposite direction, into another tube shaping member, in which the same erecting process takes place as just described.

From the tube shaping member the length of tubing can be pushed in the direction of its longitudinal axis by ejectors onto the extruding mandrel already mentioned, where the further processing, initially the molding on of the lid, can take place.

In order to be able to locate an immovable or stationary blade or knife to provide the aforementioned incisions, rather than a cutter which is movable in the direction of delivery of the web, it is suitable if the incisions and the incising from the outer edge of the longitudinal web edges laterally to the conveying direction of the web towards the middle thereof are not made by a knife of a type, such as scissors, so that the incisions practically do not have their own width. Rather, it is more suitable if these lines, generally called "incisions", are made by punching. Thus, areas can be punched. Preferably the shape of these areas is longitudinal, i.e., instead of incsisions like a line also double line-incisions can be provided by punching out a narrow band.

In other words, using a punching knife, a strip-like portion of the web forming the incisions with the described depth towards the middle of the web can be removed, which strip has a width of 1 to 5 mm, preferably 2 to 3 mm. The assembly of a stationary knife or cutter is less expensive.

Therefore, a more simple severing station can be constructed in that as in the case of scissors, two blades are movable normally in the conveying direction of the web and facilitate the incising. However, a seeking of the two blades or a movement thereof in conveying direction of the web is not necessary.

If the punching strips are made already with the paper preparation, which strips then must not extend entirely to the outer edge of the web, then the incising means can provide the tolerance field necessary for the stationary severing knife also at the outer longitudinal edge of the web, provided the severing knife is a punching knife cutting off a partial area.

Further advantages, features and applications of the invention will emerge from the following desription of preferred embodiments, in conjunction with the accompanying drawings. In these:

and

Figure 3:
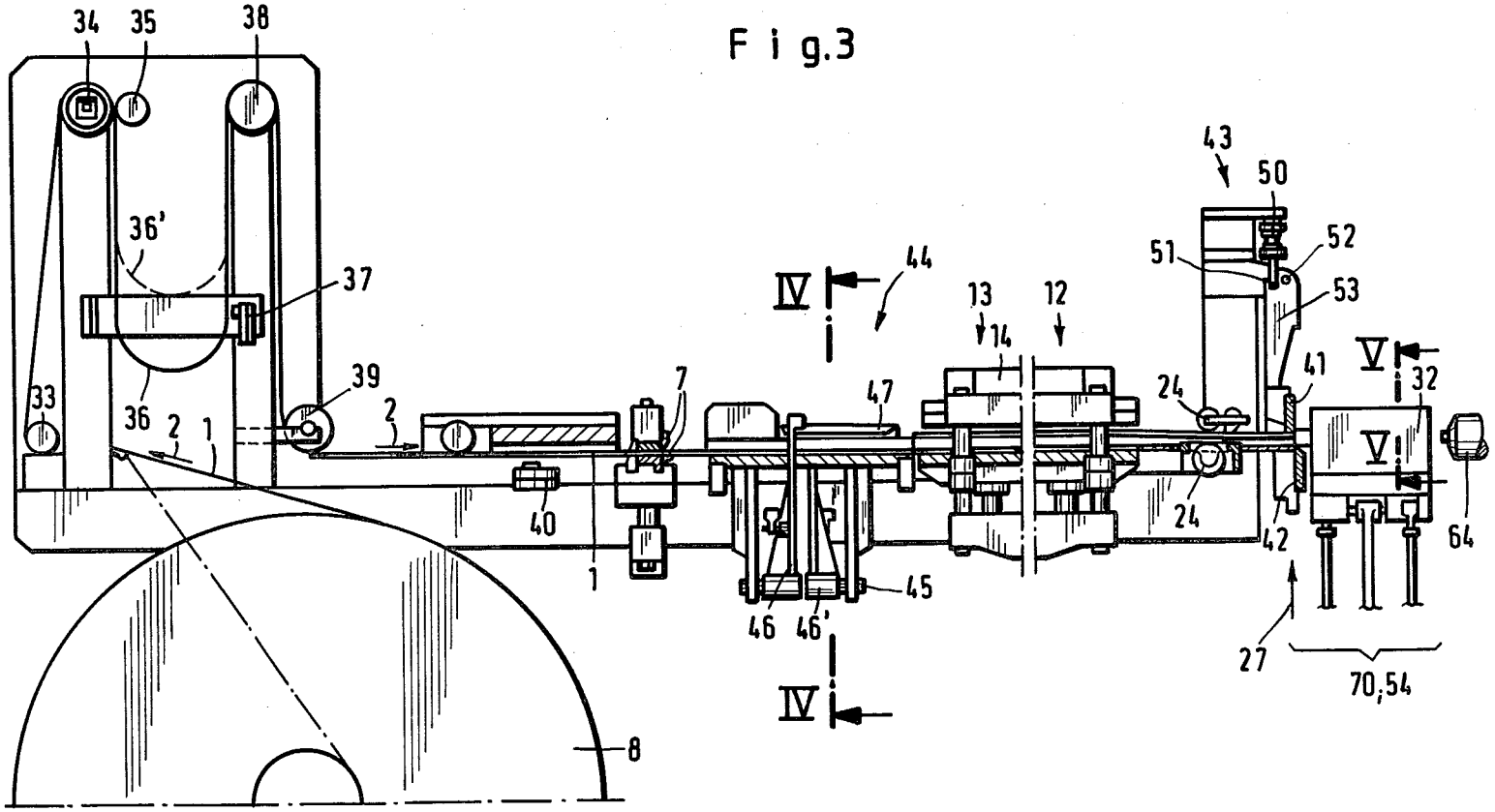
FIG. 3 is a side view of a machine for making a length of tubing or piece of tube from the flat web show in FIG. 1.
Figure 6:
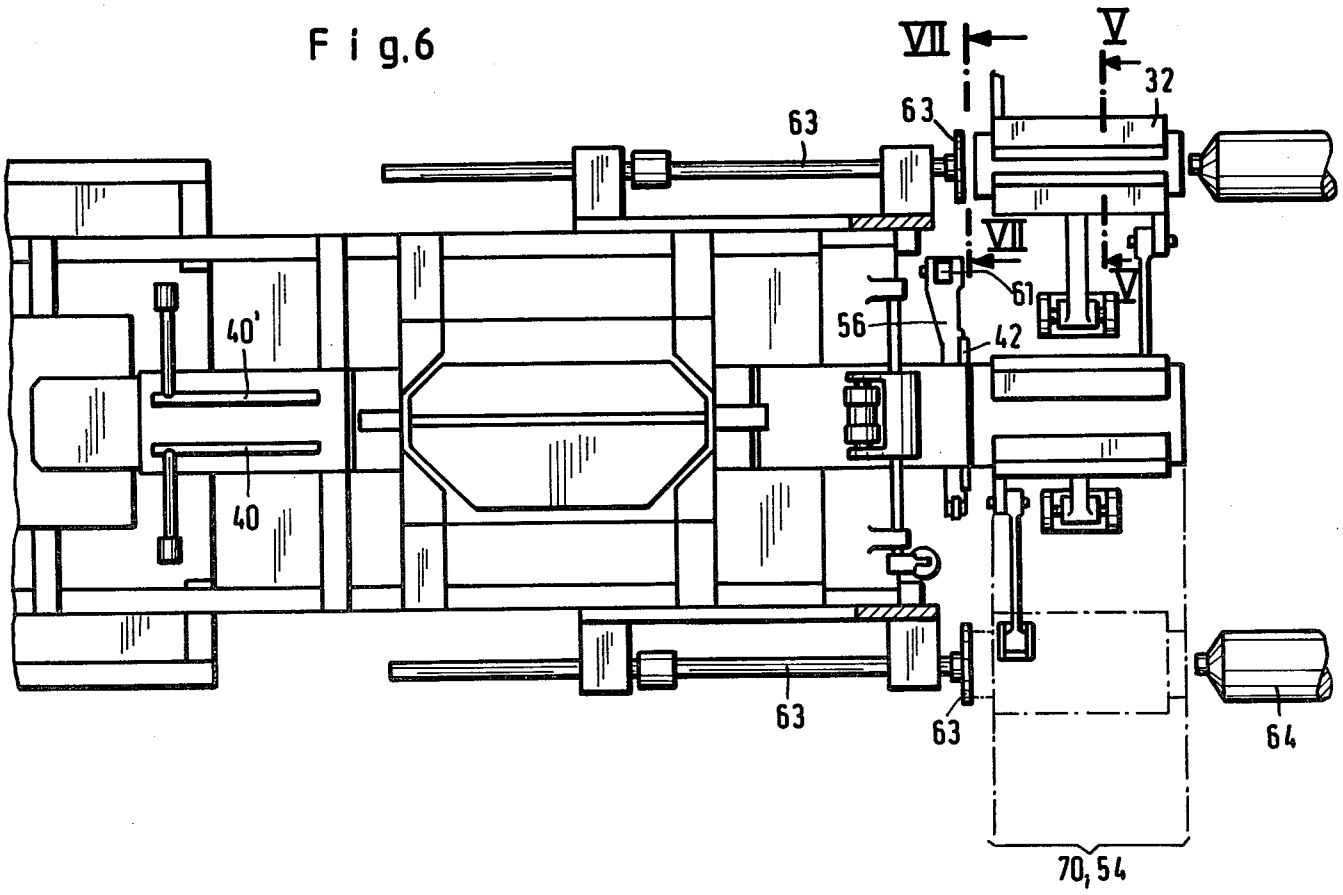

FIG. 6 is a plan view of the right-hand part of the machine in FIG. 3.

DESCRIPTION OF PREFERRED EMBODIMENTS

The web of paper 1 is assumed to be moved forward intermittently in the direction of the arrow 2 and to have the stamped section 3 already provided in the works where the paper is produced. The grooved line 4 is also assumed to be already provided in the web of paper 1. On the other hand at a distance a from the stamped section 3 the incisions 6, extending transversely to the longitudinal edges 5, are formed in the web 1 in the machine described here, namely, by the cutter 7 shown in FIG. 3.

However, it is perfectly possible for both the grooved lines 4 and the stamped section 3 to be made only in the machine shown here in the drawings. An alternative possibility is for incisions 6 to be made in the web by the paper manufacturers. If the incisions extend right across to the outer edge 5 of the web of paper 1, it is impossible to roll it up into the storage roll 8. However, this difficulty can be avoided if the paper manufacturer leaves a small web uncut at the location 9 shown at the top right-hand side of FIG. 1. The cutter 7 shown in FIG. 3 then has to make, not the incisions 6 described, extending inwards as far as the grooved lines 4, but only an incision along the line 9 (FIG. 1) in web 1.

When the incisions 6 have been made the web is then moved in direction 2 from the extreme right-hand position to the next or second position. Here the preparation takes place for folding in the side sections shown at 10, thereby forming a flat central section 11 of the web 1. The boundary of the central section 11 is formed by the two grooved lines 4. The folded-in state is shown in the third position from the right in FIG. 1, where the web 1 has become narrower by the width of the two side sections 10. In the second position the strip of width a will be seen to the left of the stamped section 3; the strip runs across from one edge 5 to the other, transversely to the conveying direction 2, and will subsequently form the seam. It will be appreciated that this seam is shorter in the third position from the right, because it is laid double.

Figure 1:
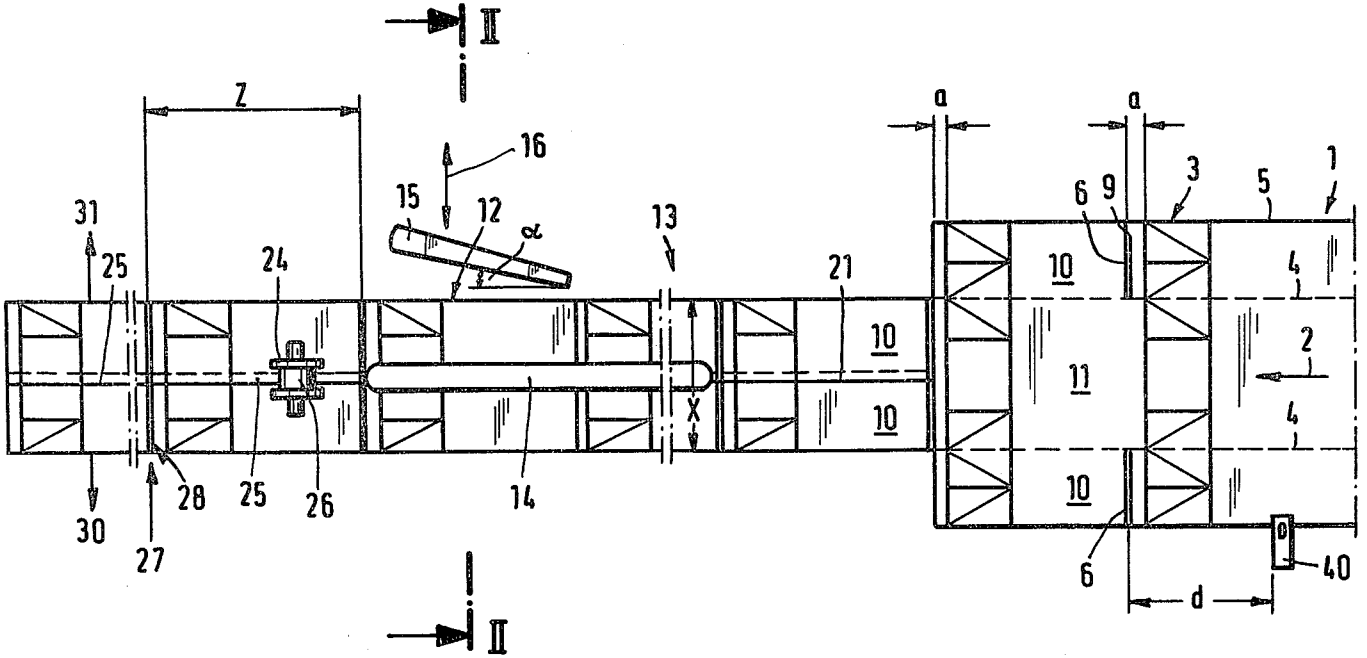
FIG. 1 is a diagrammatic plan view of a web of paper, coated with plastics on both sides, for making a piece of tube for a liquid pack.

The folding arrangement is shown in FIG. 1, with the upward fold taking place first and then the second fold in a downward direction. The initially top outside edge 5 will therefore be recognized as a continuous line in the center, while the bottom longitudinal edge 5 can only be seen as a broken line.

The web then moves on from the third to the fourth position, which belongs to the welding station 12 and constitutes the preheating region 13. The heated welding jaw 14 can already be seen here, indicated diagrammatically. The jaw 14 extends over the central longitudinal seam and softens the layers of plastic to be sealed together, in the preheating section 13, so that they can then be joined together in the actual welding station 12 to the left of the preheating station 13 in FIG. 1.

At the right-hand end of the fifth position from the right, which is the region of the actual welding station 12, the web 1 is pressed together with the aid of the pressure jaws 15, which are movable in the direction of the arrow 16, transversely of the web conveying direction 2. These jaws form the conical shape or frusto-conical shape of the piece of tube to be produced, through being arranged at a small angle $\alpha$ to the web conveying direction 2. The front end of the pressure jaws 15, as seen in the conveying direction 2 of the web 1, is narrower than the rear end.

Figure 2:
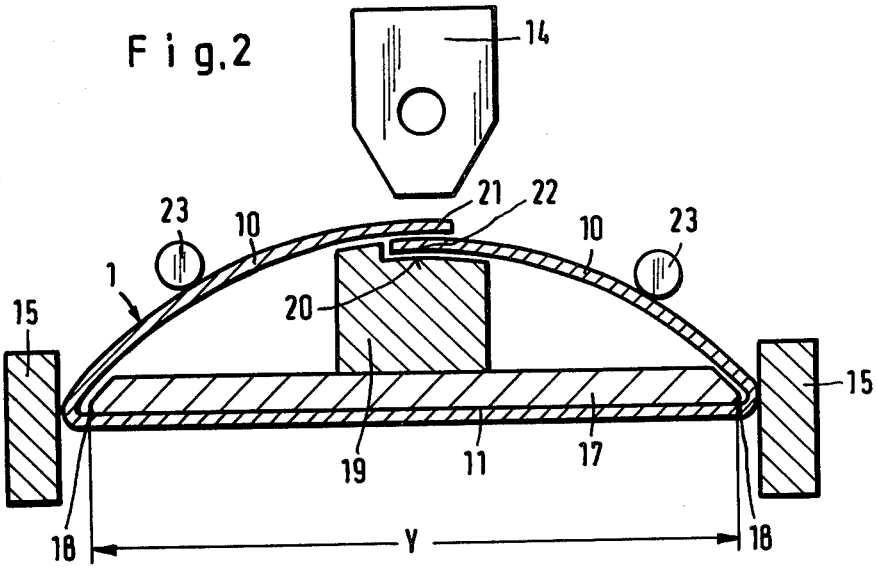
FIG. 2 is a sectional view through the FIG. 1 web, the section being taken along the line II—II.

The conical shaping of the piece of tube can be explained particuarly clearly with reference to FIG. 2. This is a cross-section through the fifth position just described, in the welding station 12, along the line II—II. The cross-section of the flat supporting plate 17 will be seen from FIG. 2. This is tapered at its two longitudinal edges 18, to enable it to sit better with the cross-sectional shape of the web 1, which is already wrapped around into a tubular shape. The cold backing jaw 19 with a step 20 will be seen to be fixed above the supporting plate 7. The end edge of the bottom side section 10, which is folded in first, can be placed in the step 20, while the top section 10 of the side wall, which is folded in afterwards, can be laid across the then smoother surface. The flat part of the web 11 is arranged at the side opposite the cold backing jaw 19 and the plate 17 supporting the side section 10. The sector-shaped cross-section of the tube, with its longitudinal edges 21 and 22 lying under the heated sealing jaw 14, will be seen from FIG. 2. Guide rails 23 are preferably provided to enable the side sections 10 to be held better in the tubular shape shown in FIG. 2.

The width "Y" of the supporting plate 17 is shown in FIG. 2; it will be seen that this is smaller than the distance "X" (FIG. 1) between the grooved lines 4. In other words, there is always some play at the edge 18 relative to the web 1 with the grooving 4.

The pressure jaws 15 can also be seen in cross-section in FIG. 2. When these are pressed towards one another they clearly eliminate the above-mentioned play, by somewhat folding over the side wall section 10 adjacent the grooved line 4 and increasing the overlap between the edges 21 and 22. This folding over takes place under slight pressure, against resistance from the web material, i.e., the paper itself, which has to be reshaped from its flat form into a definite curve.

It will be seen from FIG. 1 that this narrowing of the dimension "X" almost to the dimension "Y" takes place only at one end, the right end in the fifth position from the right in FIG. 1 in the web 1. At the opposite end the width "X" of the web 1 remains unchanged, so that later, after standing upright, the large circle of the truncated cone will be formed here and the small circle thereof at the side described first.

The feed drive rollers 24 can be seen in the sixth position from the right in FIG. 1. As shown at the right-hand side of FIG. 3, these hold down the freshly welded edges 21 and 22, so that no forces can develop such as might endeavor to burst the longitudinal seam 25 despite the slack condition of the paper. Both feed drive rollers 24 contain a central recess 26 at their peripheries, in which runs the longitudinal seam 25 which is laid double.

Before the piece of tube of length "Z" is conveyed into the seventh position, shown at the extreme left in FIG. 1, the flat fraction 11 of the web 1 is severed at the station 27, exactly in line with the incisions 6. The cut, shown at 28 in FIG. 1, extends over the entire width "X" of the piece of tube and severs one piece of length "Z" from another.

Figure 5:
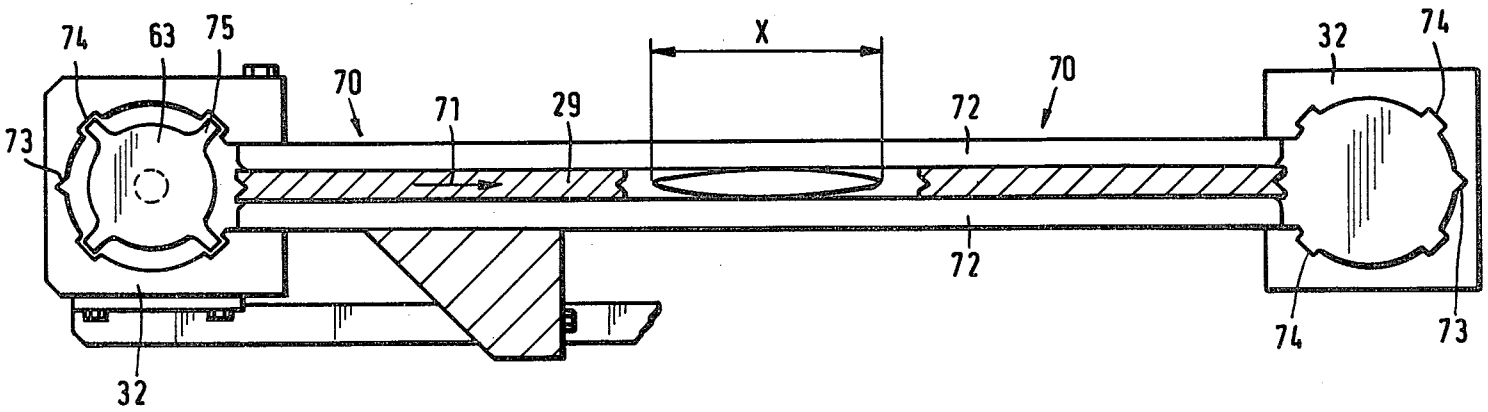
FIG. 5 is a broken-off diagrammatic sectional view, the section being taken along the line V—V in FIGS. 3 and 6.

When cutting and thus separation of the piece of tube is completed, a slide shown in FIG. 5 sends the piece of tube sideways in the direction of the arrow 30 or 31 into tube forming members 32, where the flat tube is stood upright in circular form.

The web and the apparatus processing can be seen from the side in FIG. 3. The web 1 is drawn off the reel 8 in the conveying direction 2, pulled by grooving rollers 33 and the roller motor 34 with a contact roll 35. The function of the grooving rollers 33 is to form the grooved lines, shown at 4 in FIG. 1, about which the inward folds taken place. The roller motor 34 pulls the web of paper 1 from the grooving station 33 via a loop 36 to two further direction changing rollers 38 and 39. This transfer of conveying force from the roller motor 34 takes place via the contact roll 35. The roller motor 34 is conrolled by the photoelectric cell 37. The loop 36 can assume various positions, e.g., including the position 36′ shown in broken lines at the top. After leaving the lower direction-changing roller 39 the flat web of paper 1 is sent in the conveying direction shown by the arrow 2. It passes over a photoelectric cell 40 which controls the feed drive rollers 24.

As already described above in connection with the material to be processed, the cutters 7 make the transverse cuts 6 (or 9) transversely to the longitudinal edges 5 of the web of paper 1. In this connection, the spacing d between the incisions 6 and the photoelectric cell 40 will be seen from FIG. 1. This spacing should be the same for pieces of tube for all lengths; to adapt the machine to pieces of tube of varying lengths it is given a different, calculated distance between the cutters 41 and 42 (upper and lower cutters) of the severing station 43.

When the incision 6 has been made the web 1 passes into the folding-in station shown generally at 44. Here, levers 46 and 46′ for the opposite side, are provided, each rotatable about a spindle 45 located in the web-conveying direction 2, and fixed to the levers, transverse mandrels 47 extending parallel with the spindle 45.

Figure 4:
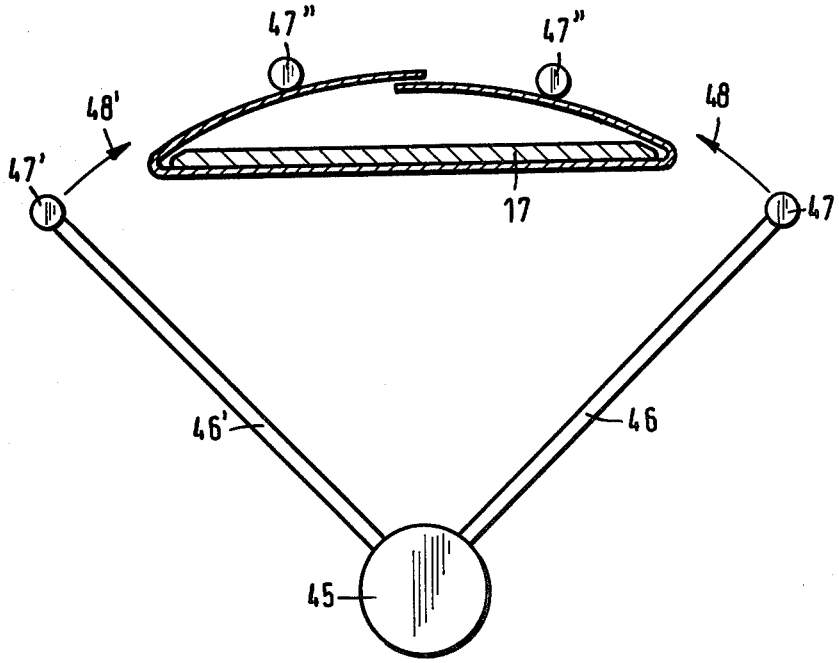
FIG. 4 is a sectional view through the folding station, the section being taken along the line IV—IV in FIG. 3.

The construction of the folding station 44 can be seen from FIG. 4, which is viewed in the conveying direction 2. When the flat web of paper is in the folding station, the transverse mandrels 47 and 47′ are swivelled upwards along the arrows 48 and 48′ by means of the respective levers 46 and 46′, so that mandrels 47 and 47′ are moved into the positions 47″. The mandrels remain in these positions while the web of material, i.e., the coated paper, engages the supporting plate 17 as shown in FIG. 2. When it advances out of the folding station 44 into the welding station 12, the mandrels 47 and 47′ stay in positions 47″ to give the side sections 10 a better hold and rough guidance. Only when the length of web in question has entered the preheating zone 13 of the welding station 14 do the mandrels 47 and 47′ move back to their starting positions.

After preheating in the zone 13, the length of web is fully welded in the welding station 2, the two strips 21 and 22 shown in FIG. 2 being joined together by constant contact heat.

By means of the feed drive rollers 24 the web is then conveyed further to the right in FIG. 3, until the incisions 6 or 9 have reached the position 27 (FIG. 1). Here the severing cutters 41 and 42 are arranged and provide for the severing of the still flat length of web 11, and thus for the separation of the piece of tube.

By virtue of the multiple steps taken by the web 1 from one station to another—until the final step to the feed drive rollers 24 and the rotatably suspended cutter 41, 42—a tolerance has to be allowed at the cutting station 27, which the cutters 41, 42 should follow. The upper cutter 41 and lower cutter 42 are suspended together, articulated to a point 52, and can be swivelled about the axis 61 (FIG. 6) relative to one another like scissors. This produces the cut. To the right of the station 27 in FIG. 3 the upright tube portion can be seen with the side sections 10 as shown in FIG. 2, while to the left thereof, this tube portion with the side sections 10 is held down by the feed drive rollers 24. This provides a stop for the upper cutter 41, which pendulates from left to right about the spindle 52, and which on meeting the stop can make the cut at exactly the desired place in alignment with the incisions 6.

A pneumatic cylinder 50 can be seen in the top of the severing station 43 in FIG. 3, the piston of the cylinder being connected at the point of rotation 51 to the short lever of the swivel arm 53 (as far as the point of rotation 52). This "searching cutter" operates as follows: when severing has taken place at position 27, the cutters 41, 42 together with the swivel arm 53 swing back clockwise about the point of rotation 52, driven by the pneumatic cylinder 50. When the web to be cut, i.e., the partly incised tube, then advances to the position shown in FIG. 3, the rotary direction of the swivel arm 53 is reversed, so that when the incisions 6 in the web have reached their final position at the station 27, when the photoelectric cell 40 has given the advancing rollers 24 the "stop" command, the upper knife 41 moves forward against the stop and can then carry out the severing operation.

At the next advance the web runs into the shaping station shown generally at 54. This can be seen in plan view in FIG. 6 and in a cross-sectional view in FIG. 5, the section being taken along a line V—V in FIGS. 3 and 6. This station is also the distributing station 70, in which the particular separated piece of tube, as in FIG. 1, is moved laterally out of the conveying direction 2 of the web 1 in the direction of the arrow 30 or 31. This outward movement is produced by the slide 29, which is in each case in its inoperative position outside the width "X" of the web. This substantially reappears in FIG. 5, although after leaving the supporting plate 17 the length of tube has taken on a somewhat different shape from that shown in FIG. 2. This length of tube is now pushed to the right by the slide 29, e.g., in the direction of the arrow 71 in FIG. 5, the slide 29 and piece of tube moving within connecting rails 72. The rails 72 may also be of plate-like construction. They are joined at the ends to the tube-shaping members 32, which are hollow inside and have a longitudinal axis parallel with that of the piece of tube. At the side opposite the gap for the slide 29, the tube-shaping member 32 carries an internal notch 73, in which the right-hand edge of the piece of tube shown in FIG. 5 can be centered after being pushed in. This ensures that the longitudinal seam, which is laid double with the edges 21 and 22, will remain exactly at the correct position in the shaping member 32. Recesses 74 can further be seen to the right of the cross-sectional view in FIG. 5. These do not interfere with setting the piece of tube upright in the form of the then truncated cone, but advantageously form guide rails for pushing the erected piece of tube out onto the mandrel 64 shown both in FIGS. 3 and 6.

The arrangement of ejectors 63 can be seen from FIG. 6, and the front view thereof on the left-hand side of FIG. 5. Corresponding to the recesses 74 in the shaping member 32, the front sliding plate of the ejector 63 has extensions 75, in which the piece of tube is securely engaged during ejection. In this way the separated piece of tube can be pushed up out of the tube-shaping member 32 onto the mandrels 64.

Although two slides 29 are shown in FIG. 5, there is in fact only one slide 29, which moves into either one of the t vo positions illustrated.

In FIG. 1, the incision 6 is shown as a double line so that here, already, the punched incision 6 and the punched strip can be recognized. In the lower part this punched strip extends from the outer longitudinal edge to the perforating line 4 which runs in the conveying direction 2. In the upper part, the other alternate embodiment is shown having this punched strip 6 not entirely extending up to the upper edge. With this last mentioned embodiment, the punched incision is already produced during the preparation of the paper, followed by winding the web 1 onto a roller. Thus, in the machine as described here, just the incision 9 at the edge has to be made, which also can be produced by a punching knife such that the incision created thereby has a width itself, i.e., is a punched strip. The incision and the punched strip 6 respectively, as well as the punched strip 9 resulting therefrom, have a width of preferably 2 to 3 mm.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. A method of making a piece of tube from a flat web of flexible material, particularly paper coated with plastics, by grooving, stamping, cutting and folding, wherein the web is intermittently fed from a storage roll, formed into a tube by folding over longitudinal edges of the web which are then continuously interconnected by adhesion, welding or the like, and the web is severed transversely into separate tubes, and wherein before the longitudinal edges of the web are joined, the web is partly incised at least from one longitudinal side, transversely to the conveying direction, the tube is formed only by folding in these side sections divided by the incisions, the non-incised part of the web is kept supported substantially flat, and when the longitudinal edges of the web have been joined, the flat non-incised portion is severed in line with the previous incisions.

2. A method according to claim 1, wherein the incisions are made of approximately equal length from both longitudinal edges of the web, the inner end of the incisions extending as far as a grooved longitudinal line formed in the web, and the sum of the areas of the side sections formed between the incisions is larger than the area of the central, flat portion of the web between the grooved lines and successive pairs of incisions.

3. A method according to claim 2, wherein the said side sections are pressed together at one end adjacent the incisions to form a cone.

4. A method according to claim 1, wherein after severing of the flat portion of the web, each separated piece of tube is moved transversely to the conveying direction of the web and is stood upright to gain a circular cross-section.

5. Apparatus for making pieces of tube from a flat web including a flat supporting plate, extending from a folding-in station to a severing station, which is held stationary in the conveying direction of the web so that a web conveyed through the apparatus engages at least partly around it, feed drive rollers arranged above and below the web in the conveying direction between a welding station which has at least one constant contact heating jaw and a severing station which has a movable cutter, and a distributing station with a means for standing upright tubes cut from the web at the severing station arranged downstream.

6. Apparatus according to claim 5, wherein at the folding-in station the folding-in means includes levers rotatable about a spindle lying in the web conveying direction, and mandrels fixed to the levers and extending parallel with the spindle.

7. Apparatus according to claim 5, wherein upstream of the folding station in the web-conveying direction, there is an adjustably movable incising means with a photoelectric cell controlling the drive rollers.

8. Apparatus according to claim 5, wherein welding means at the welding station has pressure jaws, arranged beside the edges of a supporting plate and movable at a small angle of inclination $\alpha$ thereto.

9. Apparatus according to claim 5, including at least one feed drive roller having a central recess in its peripheral surface.

10. Apparatus according to claim 5, wherein the said means at the distributing station includes connecting rails extending transversely to the web-conveying direction and spanning the width of a supporting plate, tube shaping members being fixed to the ends of the rails, and a slide being guided movably between them.

11. The method of claim 1 wherein the incising of the web is performed laterally to the delivering direction by punching, such that the incisions extending from the longitudinal edge of the web inwardly in transverse direction, have a width of at least 1 mm.

12. The apparatus of claim 6, wherein the cutters of the severing station are stationary relative to the delivering direction of the web.

13. The apparatus of claim 7, wherein the incising means is a punching knife cutting off a partial area.

* * * * *

UNITED STATES PATENT AND TRADEMARK OFFICE

CERTIFICATE OF CORRECTION

PATENT NO. : 4,469,542

DATED : September 4, 1984

INVENTOR(S) : Wilhelm Reil

It is certified that error appears in the above-identified patent and that said Letters Patent are hereby corrected as shown below:

Item [73] Assignee: "Tetra Pak Development S.A." should be -- Tetra Pak Developpement S.A. --.

Col. 8, line 11, "plate 7" should be -- plate 17 --.

Signed and Sealed this

*Nineteenth* Day of *February 1985*

[SEAL]

*Attest:*

DONALD J. QUIGG

*Attesting Officer* *Acting Commissioner of Patents and Trademarks*